United States Patent [19]

Kiuchi et al.

[11] 4,024,978

[45] May 24, 1977

[54] TANK FOR USE WITH ELECTRIC EQUIPMENT

[75] Inventors: Tadashi Kiuchi; Kiyoto Hiraishi, both of Hitachi; Motoharu Taneda, Matsudo, all of Japan

[73] Assignee: Hitachi, Ltd., Japan

[22] Filed: Oct. 10, 1975

[21] Appl. No.: 621,557

[30] Foreign Application Priority Data

Oct. 14, 1974 Japan ..... 49-117131

[52] U.S. Cl. ..... 220/5 A; 220/71

[51] Int. Cl.[2] ..... B65D 7/44

[58] Field of Search ..... 220/5 A, 71, 73, 72, 220/74

[56] References Cited

UNITED STATES PATENTS

| | | | |
|---|---|---|---|
| 1,835,815 | 12/1931 | Shanor | 220/5 A |
| 2,395,685 | 2/1946 | Schmitz, Jr. | 220/5 A |
| 2,573,995 | 11/1951 | Sparling | 220/71 X |
| 2,634,019 | 4/1953 | Pfaff | 220/71 |
| 2,675,940 | 4/1954 | Schmitz | 220/71 |
| 2,684,174 | 7/1954 | Schmitz | 220/71 X |
| 2,813,655 | 11/1957 | Hall | 220/71 |
| 3,358,616 | 12/1967 | Brodhead | 220/5 A X |
| 3,367,526 | 2/1968 | Schmied | 220/71 X |
| 3,640,419 | 2/1972 | Baker | 220/71 X |
| R4,707 | 1/1872 | Munzinger | 220/5 A |

*Primary Examiner*—William I. Price
*Assistant Examiner*—Stephen Marcus
*Attorney, Agent, or Firm*—Craig & Antonelli

[57] ABSTRACT

A tank for housing electric equipment, which is composed of at least upper and lower parts, with its parting line running in the horizontal direction, and in which the aforesaid upper and lower parts are coupled to each other by means of respective interconnecting flanges formed on the upper and lower parts of the tank, and a plurality of vertical reinforcing stays are secured to the outer surfaces of the upper and lower parts of the tank, respectively. In this tank, the vertical reinforcing stays are secured in a manner that the ends thereof face each other in the vertical direction and the walls of the vertical reinforcing stays at their ends are coupled to each other by means of interconnecting reinforcing members or by welding, so that there may be obtained a continuous or smooth distribution of bending moments over the vertical reinforcing stays, thereby avoiding stress concentration thereon, with the resulting increase in the mechanical strength of the tank.

12 Claims, 16 Drawing Figures

TANK FOR USE WITH ELECTRIC EQUIPMENT

BACKGROUND OF THE INVENTION

1. Field of the Invention

This invention relates to a tank for use with an electric such as a transformer or a reactor of a large capacity, and more particularly to a tank for use with an electric equipment, which is composed of at least upper and lower parts, with its parting line running in the horizontal direction.

2. Description of the Prior Art

Recently, transmission and distribution voltages have been raised to ultra-high levels of as 500 KV, while the capacity of power transformer is increased to the order of 1000 MVA, so that the size of electric equipment for use in a power transmission or distribution system, such as for instance, a transformer, is increased to a great extent. For simplicity of description, a transformer will be referred to herein as an example of one application of the present invention.

With a transformer having a large capacity of, for example, 500 KV, a tank, which houses therein the iron core and windings of the transformer is composed of an upper part 1 and a lower part 2, as shown in FIG. 1. Pairs of vertical reinforcing stays 5, 6 on the upper and lower parts of the tank align with each other in the vertical direction and are secured to the outer surfaces of the upper and lower parts 1, 2 of the tank, respectively. The upper and lower parts 1, 2 are formed with interconnecting flanges 3, 4, respectively, so that the vertical reinforcing stays 5, 6 are discontinued in the position of the interconnecting flanges 3, 4, when mated with each other. This in turn causes a descrease in the mechanical strength of the reinforcing stays 5, 6 in the aforesaid position, when the tank is subjected to internal and external pressures. To avoid this, the respective paired stays 5, 6 are coupled to each other by means of reinforcing interconnecting members 7 and bolts 8.

However, such an arrangement suffers from shortcomings in that the aforesaid bolts 8 only serve as anchors for the reinforcing interconnecting member which is subjected to an elastic deformation due to a bending moment created by an internal pressure or an external pressure, and that the interconnecting flanges 3, 4 provide pin joints for the bending moment, in their appearance.

This will be described in more detail with reference to FIGS. 1 to 4, hereunder.

When uniformly distributed external pressure W acts on a tank composed of an upper part 1 and a lower part 2 which are coupled to each other by means of interconnecting flanges 3, 4, the distribution of bending moments is such that, as shown in FIG. 4 (B), the bending moment is nullified in the position of the interconnecting flanges 3, 4, while the bending moments M are increased at points spaced increasingly from the flanges 3, 4 in the vertical direction, peaking on the corners of the upper and lower parts 1, 2 of the tank. A noticeable stress concentration takes place on th corners of the upper and lower parts 1, 2 of the tank, because of the addition of the bending moments in the widthwise direction. Thus, the vertical reinforcing stays 5, 6 fail to achieve their functions to reinforce the mechanical strength of the tank to satisfaction, with the accompanying failure to provide rigid and strong joints for the interconnecting flanges.

The aforesaid bending moments will be described in more detail hereunder. As shown in FIG. 3, the vertical reinforcing stays 5, 6, which are secured to the upper and lower parts l, 2 of the tank, are completely discontinued because of the presence of interconnecting flanges 3, 4 so that the stays 5, 6 are coupled to each other by the means of the reinforcing interconnecting members 7 which are attached to the outer surfaces of the stays 5, 6. Accordingly, in case an external pressure is exerted on the tank, the outer walls of the respective vertical reinforcing stays 5, 6 are subjected to a compression due to bending moments, as shown by arrows (solid lines), while the inner walls of the stays 5, 6 (on the side of the tank) are subjected to a tension, as shown by arrows (dotted lines), and in addition the center portions of the stays are subjected to a shear force. Meanwhile, since the reinforcing interconnecting members 7 are attached to the outer surfaces or walls of the vertical reinforcing stays 5, 6 and are secured thereto by means of bolts 8, the transmissions of the compressions and tension forces are effected only through the inner walls of the reinforcing interconnecting members 7 i.e., through the walls of the members 7 on the side of the tank, while a shear forces is transmitted through part of the reinforcing interconnecting members (bolts 8), due to the absence of members for transmitting the shear force. This approximates the so-called pin - joint. As a result, the bending moments are greatly increased on the corners of the upper and lower parts of the tank, as shown in FIG. 4 (B).

To avoid this, there has been proposed a tank contruction in which the interconnecting flanges of the upper and lower parts of the tank are made as a complete rigid joint i.e., as an integral body. This provides an advantage in that the distribution of the bending moments exhibits quadratic characteristics which are continuous in both widthwise and lengthwise directions of the tank, as shown in FIG. 5 (B), thus eliminating the concentration of the bending moments on the corners of the tank, and as a result, for achieving a desired mechanical strength of the prior art tank, the joints of the intermediate flange portions should be rigid. However, this attempt at solutions to the problem suffers from a shortcoming in that the rigidity of the interconnecting flanges is lower than that of the reinforcing interconnecting members adapted to interconnect the vertical reinforcing stays. For this reason, to increase the rigidity and mechanical strength of the joints between the upper and lower parts of the tank, it is imperative that the sizes of the reinforcing interconnecting members as well as the interconnecting flanges be increased to an extent more than required, and that, in the worst case comes to the worst, the thicknesses of steel plates used in the tank must be increased, thus raising the manufacturing cost of the tank.

SUMMARY OF THE INVENTION

It is accordingly an object of the present invention to provide a tank for housing electric equipment, which improves the distribution of bending moments so as to eliminate the stress concentration on the corners of a tank as well as improves the mechanical strength of the tank.

According to the present invention, there is provided a tank of the type, which is composed of at least upper and lower parts formed with interconnecting flanges, respectively, while the vertical reinforcing stays are secured to the outer surfaces of the upper and lower parts of the tank, respectively, with the ends of the aforesaid vertical reinforcing flanges facing each other, the aforesaid tank being characterized by effective interconnecting members which interconnect the aforesaid ends of the reinforcing stays. The aforesaid reinforcing interconnecting members are contemplated to improve the distribution of bending moments of the tank according to an arrangement that the interconnecting members are formed rigidly or intergrally with the ends of the reinforcing stays, respectively, or in a manner to span the aforesaid interconnecting flanges to go round the flanges.

BRIEF DESCRIPTION OF THE DRAWINGS

FIGS. 8 (B), 9 (B), 10 (B) are cross-sectional views taken along the lines A—A' of the corresponding figures.

DESCRIPTION OF THE PREFERRED EMBODIMENTS

Description will be given of a tank for use with an electric equipment for example of a transformer, with various types of pipings omitted, in conjunction with FIGS. 6 and 7, hereunder. As is well known, a tank is composed of at least upper and lower parts 11 and 12 into which the tank may be divided with respect to the horizontal line. Interconnecting flanges 13, 14 are welded integrally to the upper and lower parts 11, 12 of the tank, while a plurality of vertical reinforcing stays 15, 16 are welded at a given spacing to the outer surfaces of the parts 11, 12, respectively, for the purpose of reinforcing the tank. After an iron core, windings and the like have been housed in the tank, the interconnecting flanges 13, 14 are coupled together by means of a plurality of bolts or are welded together. A plurality of vertical reinforcing stays 15, 16 are made of H- or T-sections or a rectangular steel section and positioned, with their ends in opposing relation when the interconnecting flanges 13, 14 are coupled together. The vertical reinforcing stays 15, 16 are rigidly coupled together by means of a suitable interconnecting means 17 to be described hereinafter.

Figure 6:
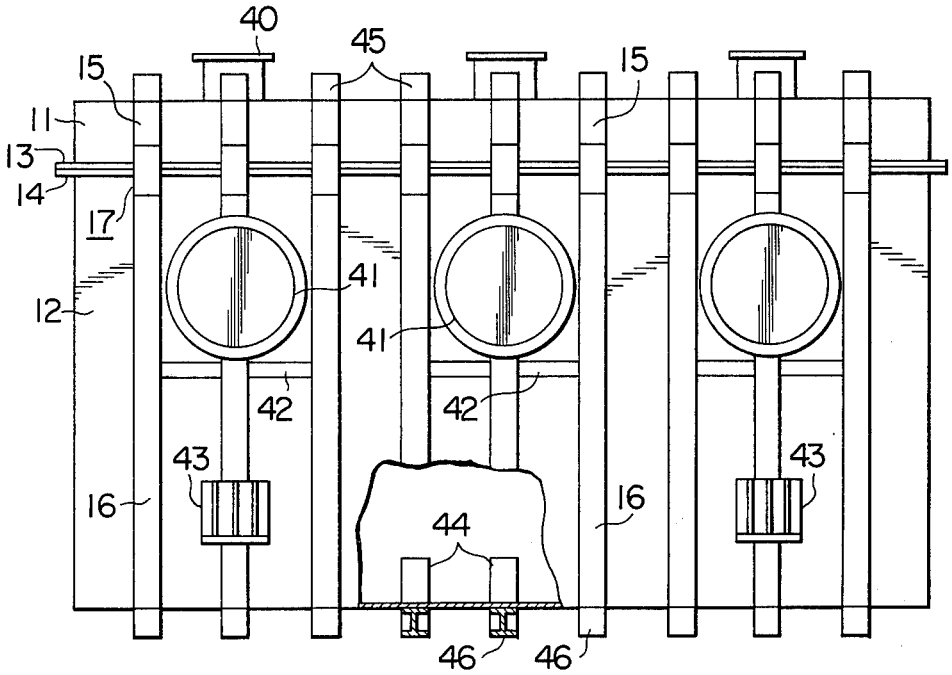
FIG. 6 is a front view, partially in cross-section, of a tank for use with an electric equipment, according to the present invention.
Figure 7:
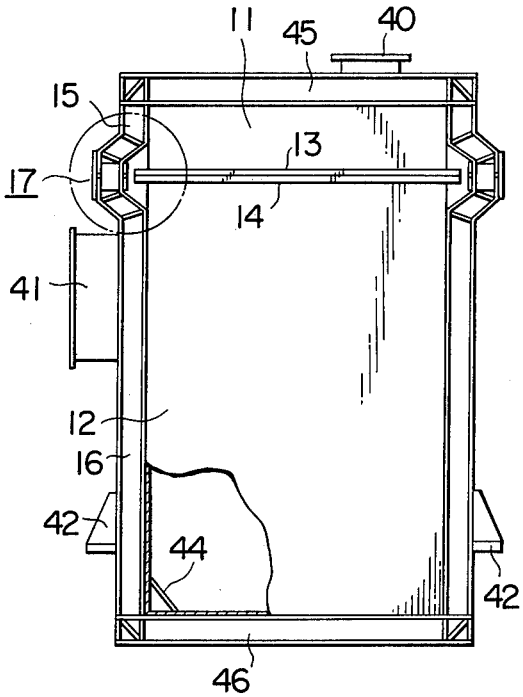
FIG. 7 is a side view, partly in cross-section, of the tank of FIG. 6.

With the embodiment shown in FIGS. 6 and 7, there are used vertical reinforcing stays 15, 16 made of H-sections, which extend in a manner to go around the interconnecting flanges 13, 14 outwardly thereof, with the ends of the respective stays facing each other in the vertical direction. However, the aforesaid reinforcing stays need not necessary go round the interconnecting flanges in the aforesaid manner, but may be modified in a suitable manner, depending on the construction of the interconnecting means 17.

Various examples of the interconnecting means 17 for the vertical reinforcing stays 15, 16 will be described.

Figure 8A:
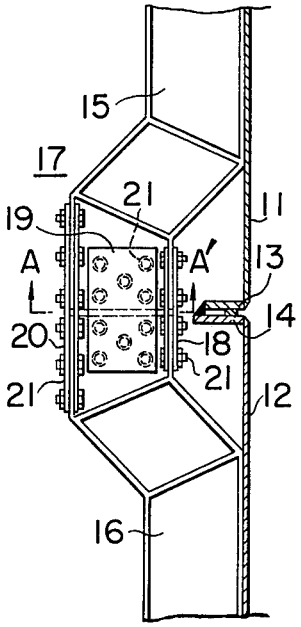
FIGS. 8 (A), 9 (A), 10 (A) are views, partly in cross-section, of a portion encircled with a one-point chain line in FIG. 7.
Figure 8B:
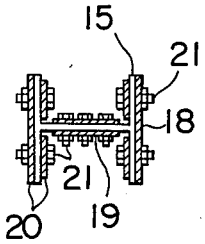

The respective vertical reinforcing stays 15, 16 are coupled together by means of interconnecting means 17 shown in an enlarged views in FIG. 8 (A), 8 (B), which means 17 is encircled with a one point chain line in FIG. 7. In other words, the reinforcing stays 16 secured to the upper and lower parts of the tank, as has been described earlier, go around the interconnecting flanges 13, 14, while the ends of the respective stays, i.e., the ends of the inner flanges intermediate webs and outer flanges of the H-sections are opposed to each other in the vertical direction. The interconnecting portions of the respective vertical reinforcing stays 15, 16 i.e., the inner flanges, intermediate webs and outer flanges of H-sections of the stays 15, 16 are coupled together by means of intermediate interconnecting members 18, 19, 20 by using fastening means 21 such as bolts.

Figure 1:
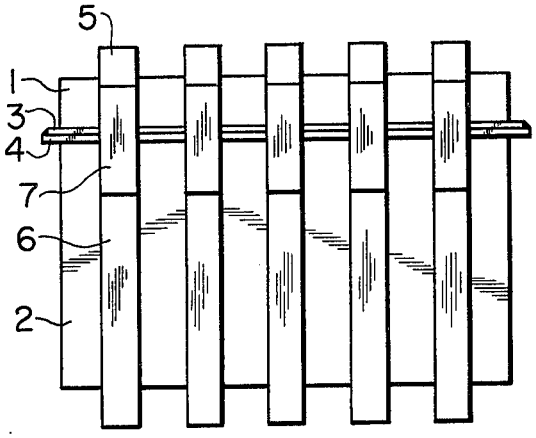
FIG. 1 PRIOR ART
FIG. 1 is a front view of a prior art tank for use in an electric equipment.
Figure 2:
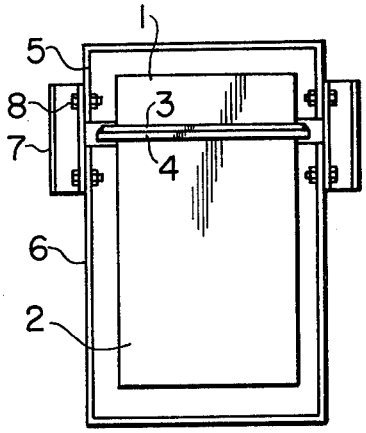
FIG. 2 PRIOR ART
FIG. 2 is a side view of the tank of FIG. 1.
Figure 4A:
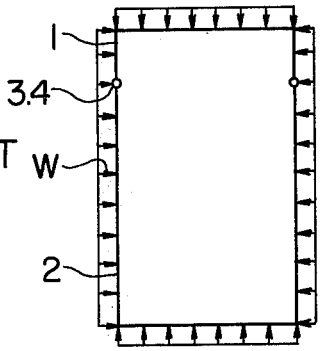
FIG. 4A PRIOR ART
FIG. 4 (A) and (B) are a pressure distribution diagram and a bending moment distribution diagram of a split type tank which is subjected to a uniform external pressure, respectively.
Figure 4B:
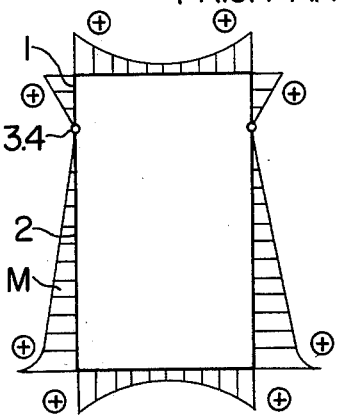
FIG. 4B PRIOR ART
Figure 3:
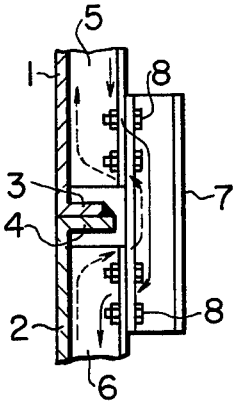
FIG. 3 PRIOR ART
FIG. 3 is partial cross-sectional view of the tank of FIG. 2.
Figure 5A:
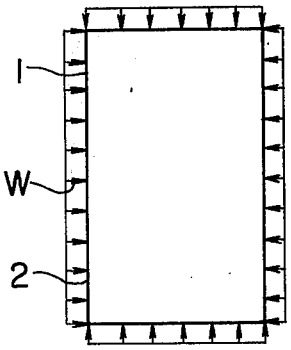
FIG. 5A PRIOR ART
FIG. 5 (A) and (B) are a pressure distribution diagram and a bending moment distribution diagram of an integral type tank, which is subjected to a uniform external pressure.
Figure 5B:
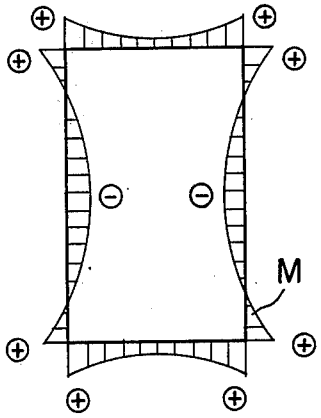
FIG. 5B PRIOR ART

Thus, there may be obtained a tank in which the vertical reinforcing stays 15, 16 run from the bottom end to the top end of the tank, being secured to the outer surface of the tank by means of the interconnecting means 17. Even if a uniformly distributed external pressure is applied to the tank, as shown in FIG. 5 (A), i.e., even if the inner flanges of the vertical reinforcing stays 15, 16 are subjected to a tension, the outer flanges thereof to a compression, and the intermediate web thereof to a shear force, the aforesaid stresses are transmitted to the corrresponding parts, so that the stresses to be borne by the interconnecting flanges 13, 14 of the upper and lower parts 11, 12 of the tank are reduced to a considerable degree, and the bending moments acting on the respective portions of the tank exhibit a continuous distribution as shown in FIG. 5 (B). This in turn minimizes the stress concentration on the corners of the tank, thereby increasing the mechanical strength of the tank using the vertical reinforcing stays.

In addition, since the interconnecting means 17 consists of intermediate interconnecting members 18, 19, 20 and fastening means 21 such as bolts, the strength of the interconnecting means 17 may be effectively adjusted by selecting the types of the materials and thickness of the interconnecting means. In addition, the interconnecting means 17 may be removed with ease, thus saving manufacturing man hours to a great extent, upon assembly and disassembly of the tank.

Figure 9A:
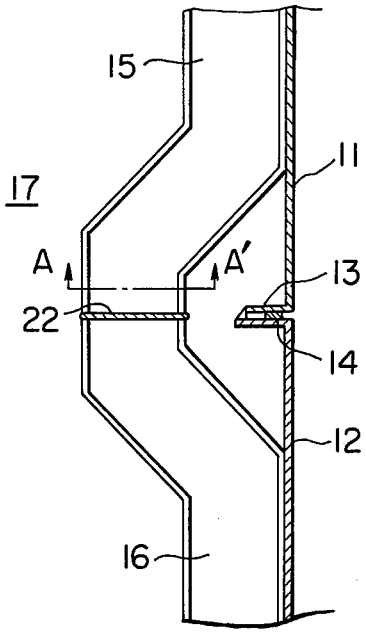
Figure 9B:
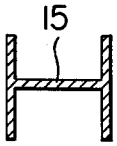

There are shown other examples of the interconnecting means 17 in FIG. 9 (A), 9 (B). As in the previous case, the vertical reinforcing stays 15, 16 on the upper and lower parts 11, 12 of the tank are made of H-sections of steel, and extend around the interconnecting flanges 13, 14 as shown, with the ends of the respective stays facing each other in the vertical direction. The walls of the stays at their opposing ends are welded together according to standard welding techniques (as shown at 22). Thus, there may be obtained vertical reinforcing stays 15, 16 on the upper and lower parts 11, 12 of the tank, which stays are continuous with each other in the vertical direction. Such a provision of the stays also achieves the intended same effect as that given in FIG. 8.

In passing, the position of the welded portion 22 for the respective vertical reinforcing stays 15, 16 may be adjusted suitably, depending on the positions of the interconnecting flanges 13, 14 of the upper and lower parts 11, 12 of the tank, or on the manufacturing condition such as coupling operations of the tank.

Figure 10A:
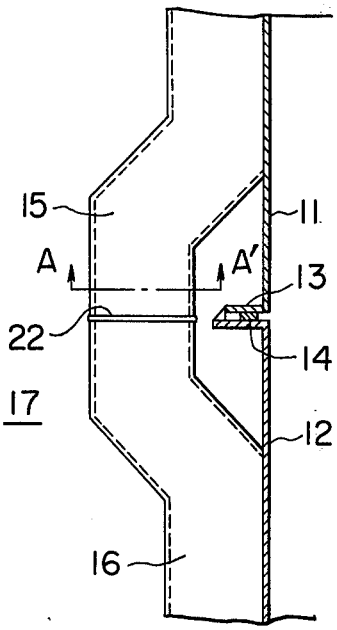
Figure 10B:
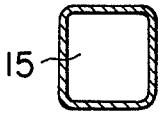

The interconnecting means 17 shown in FIG. 10 (A), (B) is similar in construction to those of examples shown in FIG. 9 (A), 9 (B), except for the use of rectangular-section steel members for the vertical reinforcing stays 15, 16, with the opposing ends of walls of the stays welded together as shown at 22.

The portions of the vertical reinforcing stays 15, 16 on the upper and lower parts 11, 12 of the tank span the interconnecting flanges 13, 14 in a manner to go around same, as shown in FIGS. 9 (A) and 10 (A), with the ends of the respective stays opposing each other in the vetical direction. In this respect, the opposing ends of the stays are welded together. However, as an alternative, those portions of the reinforcing stays which extend outwardly may be provided with other interconnecting stays in a manner to encompAss the aforesaid portions therewith, and then both vertical reinforcing stays may be welded together through aforesaid inteconnecting stays. This arrangement also provides continuous rigid joints which present a uniform distribution of bending moments.

Figure 11:
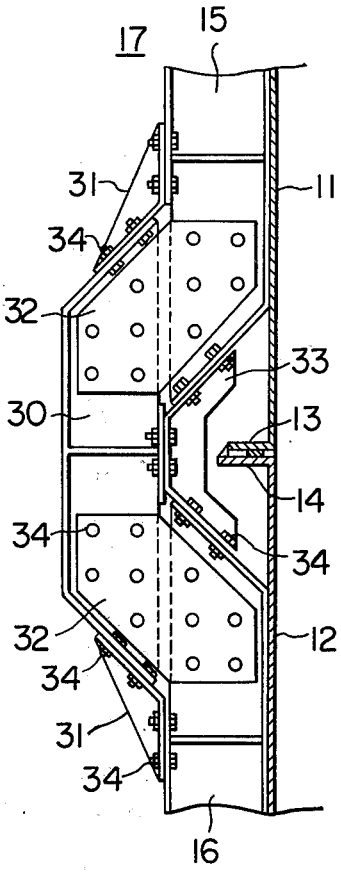
FIG. 11 is a side view, partly in cross-section, of a portion encircled with a one-point chain line in FIG. 7.

FIG. 11 shows another embodiment of the interconnecting means 17 which rigidly interconnects the vertical reinforcing stays 15, 16 made of H-sections of steel. As in the case with the embodiment shown in FIG. 8, there are used interconnecting reinforcing members and fastening means. However, the vertical reinforcing stays are not continuous in the neighborhood of the interconnecting flanges 13, 14 but cut along the outer surface of the stays, as shown. Arranged between the vertically opposing reinforcing stays 15, 16 are interconnecting reinforcing members 30 made of H-sections of steel which span the interconnecting flanges 13, 14. Intermediate interconnecting members 31, 32, 33 are secured to the inner flanges, intermediate webs and outer flanges of the interconnecting reinforcing member 30 by means of fastening means 34 such as bolts. Thus, the corresponding inner flanges, intermediate webs and outer flanges of the vertically opposing reinforcing stays 15, 16 are coupled together by mean of the interconnecting reinforcing member 30 and the intermediateinterconnecting members 31, 32, 33, in addition to the fastening means 34, thereby presenting rigid joints and a continuous distribution of bending moments, and hence the same advantages as that of the embodiment shown in FIG. 8.

The tank according to the present invention provides the aforesaid rigid joints for the vertical reinforcing stays, which permit a uniform distribution of bending moments. However, the mechanical strength of the tank may further be increased by welding C-shaped members to the outer surfaces of the interconnecting flanges 13, 14 to reinforce same, or by securing reinforcing members to the inner surfaces of the upper and lower parts of the tank in the positions corresponding to the aforesaid interconnecting flanges 13, 14.

According to the tank of the invention, there are provided not only rigid joints for the vertical reinforcing stays to maintain a desired mechanical strength but also many other provisions to be described later with reference to FIGS. 6 and 7.

The upper and lower parts 11, 12 of the tank are provided with bushing pockets 40, 41 for attachments of bushings connecting with components housed within the tank. In this respect, upon attachment of the bushings, large bending moments are created in the neighborhood of the bushing pockets 41 provided in the side surfaces of the lower part 12 of the tank. For this reason, the center of the bushing pocket 41 is so designed as to be located on the extension line of the vertical reinforcing stay 16 on the lower part 12 of the tank but between the stays adjacent to the aforesaid stay 16. In addition, for achieving further improved reinforcement, horizontal stays 42 are secured to the surfaces of the lower part of the tank. Thus, the portion in the neighborhood of the bushing pocket 41 in the lower part of the tank may be effectively reinforced. Although the reinforcing stay 16 is discontinued at the bushing pocket 41, the stresses may be transmitted through the horizontal stays to the vertical reinforcing stays adjacent thereto, so that a stress concentration will not occur on the bushing pocket 41. In addition, the discontinuation of the vertical reinforcing stays may be minimized by locating the pocket 41 right on the reinforcing stay 16, and in addition, the rigidity of the vertical reinforcing stays adjacent thereto should not necessarily be increased to a great extent.

A jack mount 3 is provided on the lower part 12 of the tank for use in setting the tank or moving same. At least two jack mounts are provided on one side of the lower part 12 of the tank in a manner to connect with the adjacent vertical reinforcing stays, and thus four jack mounts are provided in total. The provision of the jack mounts permits vertical forces to be borne exclusively by the vertical reinforcing stays 15, 16, thereby preventing excessive stresses from being exerted on the steel plates constituting the tank to improve the mechanical strength of the tank.

A plurality of top stays 45 are secured to the top surface of the upper part 11 of the tank in alignment with the vertical reinforcing stays 15, while a plurality of base members 46 are secured to the bottom surface of the lower part 12 of the tank in alignment with the vertical reinforcing stays 16. Those top stays 45 and base members 46 are welded at their ends on the corners of the tank to the ends of the vertical reinforcing stays 15 or 16, respectively, so that the entire outer surfaces of the tank are completely covered with the rigid joints or reinforcing members or stays, thus providing a tank of an integral construction, so that bending moments may be continuously or smoothly distributed as shown in FIG. 5 (B). In addition, the strength of the corners of the tank is so reinforced as to cope with stress concentration thereon, thus improving the mechanical strength of the tank. This eliminates a need to increase the thickness of steel plates used for the tank or to increase the thickness of the flanges, to an extent more than required. Thus, the tank may be manufactured economically.

If required, a plurality of reinforcing members 44 are secured to the inner surfaces of the corners of the lower part 12 of the tank for reinforcing same. (If required, to the inner surfaces of the upper part 11 of the tank.) Those reinforcing members 44 may be made of T-sections of steel and welded to the inner surfaces of the tank in the positions corresponding to those of the outer, vertical reinforcing stays 16 and base members 46. This eliminates the stress concentration on the corners of a tank, improving the mechanical strength of the tank.

According to the present invention, there is provided a tank composed of upper and lower parts 11, 12, and there are used a combination of reinforcing members such as (i) an interconnecting means 17 which interconnect the vertical reinforcing stays 15, 16, (ii) vertical reinforcing stays 16, the top stays 45, and the base members 46, all of which are secured at the respective ends thereof to each other; and (iii) reinforcing members 44 secured to the inner surface of the tank on its corners. The aforesaid reinforcing members improve the mechanical strength and distribution of bending moments of the tank, yet providing economy in the manufacture of the tank.

It should be understood that the various modificatons and alterations may be inferred by those skilled in the art without departing from the scope of the present invention. However, those modifications and alterations may be presumed to be within the scope of the invention defined in the claims that follow.

What is claimed is:

1. A tank for housing electric equipment comprising at least upper and lower tank parts, the parting line between said tank parts running in the horizontal direction and being formed with interconnecting flanges at the joining edges thereof, respectively, a plurality of vertical reinforcing stays secured to the outer surface of said upper part of said tank and having plural faces, and a plurality of vertical reinforcing stays secured to the outer surface of the lower part of said tank and having plural faces the ends of said vertical reinforcing stays on said upper and lower parts being aligned with each other in the vertical direction in facing relation, and interconnecting means for coupling the respective faces of each of said vertical reinforcing stays at said ends thereof to each other to provide a continuous distribution of bending moments over the surfaces thereof.

2. A tank for housing electric equipment as set forth in claim 1, wherein said vertical reinforcing stays secured to said upper and lower parts of said tank span said interconnecting flanges in a manner to go around said flanges.

3. A tank for housing electric equipment as set forth in claim 1, wherein said interconnecting means consists of a plurality of intermediate interconnecting members and fastening means which are secured to the outer walls of said vertical reinforcing stays which align with each other in the vertical direction.

4. A tank for housing electric equipment as set forth in claim 1, wherein said interconnecting means is welded to the walls of said vertically aligned reinforcing stays, respectively.

5. A tank for housing electric equipment as set forth in claim 1, wherein said interconnecting means comprises a plurality of interconnecting members of H-shaped cross section.

6. A tank for housing electric equipment as set forth in claim 1, wherein said interconnecting means comprises a plurality of rectangular interconnecting members.

7. A tank for housing electric equipment comprising at least upper and lower tank parts, the parting line between said tank parts running in the horizontal direction and being formed with interconnecting flanges at the joining edges thereof, respectively, and a plurality of vertical reinforcing stays secured to said upper and lower parts of said tank, respectively, said vertical reinforcing stays being secured to the outer surfaces of saidupper and lower parts of said tank and the opposing ends of said stays extending in a manner to go around said interconnnecting flanges outwardly thereof to face each other, the walls of said stays being coupled to each other by means of a plurality of interconnecting members and fastening means.

8. A tank for housing electric equipment as set forth in claim 5, wherein a bushing pocket is provided, having its center on the extension line of said vertical reinforcing stays on at least one of said upper and lower parts of said tank.

9. A tank for housing electric equipment as set forth in claim 7, wherein jack mounts are secured to said plurality of vertical reinforcing stays on said upper and lower parts of said tank.

10. A tank for housing electric equipment as set forth in claim 7, wherein reinforcing members are secured to the inner walls of said tank on its corners in the positions corresponding to those of said vertical reinforcing stays.

11. A tank for housing electric equipment as set forth in claim 7, wherein a plurality of base members are secured to the bottom of said lower part of said tank, while a plurality of top reinforcing stays are secured to the top surface of said upper part of said tank, said base members and top reinforcing stays being rigidly joined at their opposite ends to the ends of said vertical reinforcing stays.

12. A tank for electric equipment comprising at least upper and lower tank parts, the parting line between said tank parts running in the horizontal direction and being formed with interconnecting flanges at the joining edges thereof; a plurality of vertical reinforcing stays secured to said upper and lower parts of said tank, respectively, said vertical reinforcing stays being secured to the outer surfaces of said upper and lower parts of said tank, and extending around said interconnecting flanges outwardly thereof; the opposing ends of said vertical reinforcing stays being coupled to each other by means of a plurality of intermediate interconnecting members and fastening members, which are attached to the walls of said vertical reinforcing stays; a plurality of base members secured to the bottom of said lower part of said tank; top reinforcing stays secured to the top surface of said upper part of said tank, the opposite ends of said base members and said top reinforcing members being coupled to the ends of said vertical reinforcing stays, respectively; and reinforcing members secured to the inner walls of said tank on its corners in the positions corresponding to those of said vertical reinforcing stays and base members.

* * * * *